United States Patent [19]

Tishler et al.

[11] 4,292,834

[45] Oct. 6, 1981

[54] IRREGULAR SHAPE ROD BENDING APPARATUS

[75] Inventors: Albert Tishler; Murray Tishler; William Tishler; Irving Tishler; Joseph Lucchesi, all of Norwalk, Conn.

[73] Assignee: Norwalk Investment Club, Norwalk, Conn.

[21] Appl. No.: 135,200

[22] Filed: Mar. 28, 1980

[51] Int. Cl.[3] ..... B21D 7/024

[52] U.S. Cl. ..... 72/482; 72/458; 140/92.1

[58] Field of Search ..... 72/482, 481, 379, 478, 72/476, 413, 458; 140/92.1

[56] References Cited

U.S. PATENT DOCUMENTS

| | | | |
|---|---|---|---|
| 133,773 | 12/1872 | Gray | 72/385 |
| 222,182 | 12/1879 | Duncan | 72/385 |
| 337,113 | 3/1886 | Bailey | 72/400 |
| 1,042,112 | 10/1912 | Hartman | 72/388 |
| 2,533,470 | 12/1950 | Kapelis | 72/473 |
| 3,181,331 | 5/1965 | Wishing | 72/478 |
| 3,946,768 | 3/1976 | Fiorentino | 140/92.1 |
| 3,992,921 | 11/1976 | Jarman | 72/385 |

*Primary Examiner*—Gene P. Crosby

*Attorney, Agent, or Firm*—Harvey B. Jacobson

[57] ABSTRACT

A pair of elongated generally parallel mounting members are provided and a plurality of laterally spaced elongated transverse guide members extend between the support members. The opposite ends of the transverse guide members and the support members include coacting clamp and guide structure supporting the guide member ends from the support members for adjustable shifting therealong. The coacting clamp and guide structure is operative to releasably anchor the guide member ends in adjusted shifted positions along the support members and each of the guide members includes an anchor post supported therefrom, shiftable longitudinally therealong and releasably anchorable in adjusted position, the posts being disposed generally normal to a plane paralleling the mounting members and guide members.

10 Claims, 6 Drawing Figures

IRREGULAR SHAPE ROD BENDING APPARATUS

BACKGROUND OF THE INVENTION

Various forms of articles of manufacture are produced from rod-like stock and many of these articles comprise irregularly shaped rod members of different designs. Although various structures heretofore have been provided for bending rod-like members into articles of manufacture, most of these previously known structures are not capable of substantially infinite adjustment and ready adjustment to accomplish slight changes in sizes. Accordingly, a need exists for a rod bending apparatus which is substantially infinitely adjustable within a given range and which may be readily adjusted to effect changes in sizes of the articles to be manufactured thereby.

Examples of various forms of previously known devices for bending rod-like materials as well as other structures including some of the general structural and operational features of the instant invention are disclosed in U.S. Pat. Nos. 133,773, 222,182, 337,113, 2,533,470 and 3,992,921.

BRIEF DESCRIPTION OF THE INVENTION

The rod bending apparatus of the instant invention is constructed in a manner whereby a plurality of substantially vertical pins may be selectively positioned throughout a given plan area and with adjustment of the pins throughout the aforementioned plan area being easy to accomplish.

The rod bending apparatus is constructed whereby irregular shaped articles of manufacture may be produced by bending rod-like materials and in a manner enabling the articles of manufacture to be readily formed in different sizes.

A main object of this invention is to provide a rod bending apparatus which will enable irregular shaped articles of manufacture to be readily manufactured by bending rod stock.

Another object of this invention is to provide a rod bending apparatus having structural features thereof enabling substantially unlimited shaped articles of manufacture to be manufactured thereby, within a given size limitation.

Still another important object of this invention is to provide a rod bending apparatus which will enable similar irregularly shaped articles of manufacture to be produced thereby and with the similarly shaped articles of manufacture of different sizes.

A further object of this invention is to provide a rod bending apparatus whose structural features enable a workman to readily make desired adjustments thereto.

A final object of this invention to be specifically enumerated herein is to provide a rod bending apparatus in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
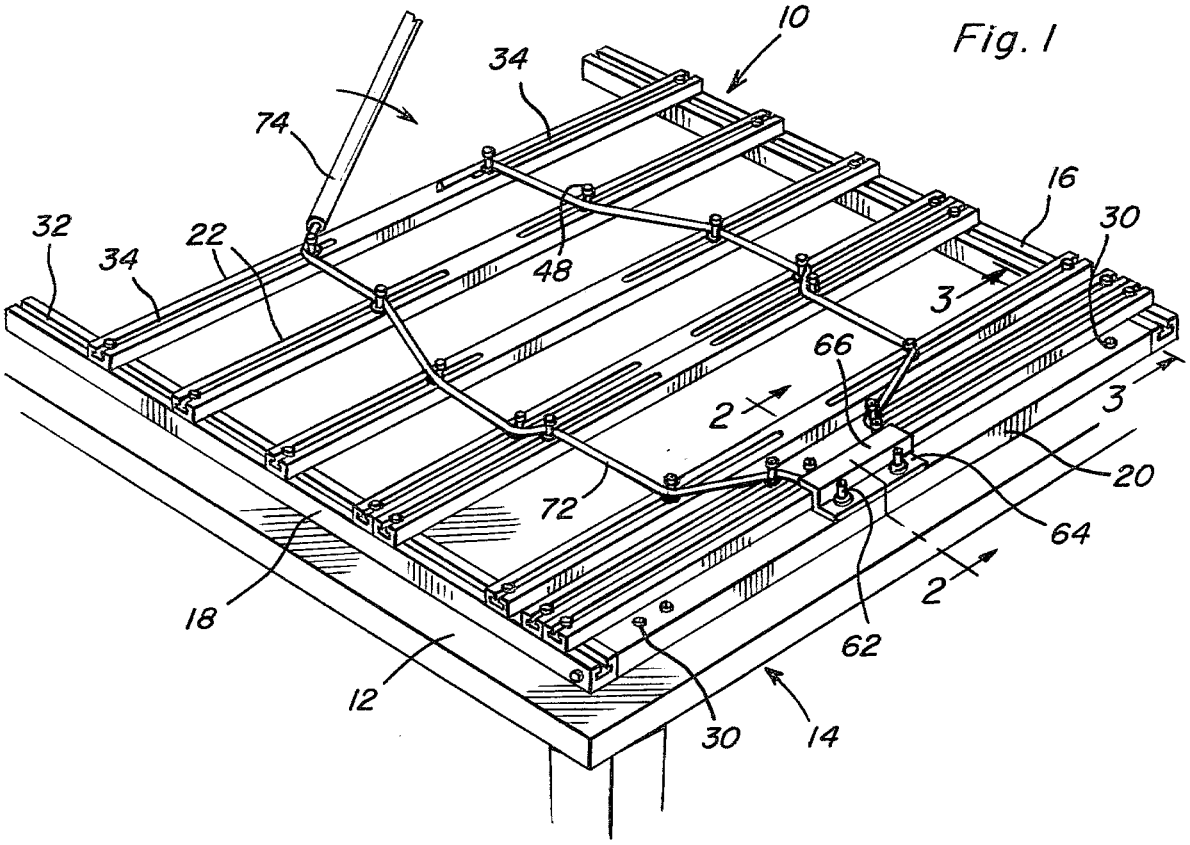
FIG. 1 is a perspective view of the rod bending apparatus of the instant invention.
Figure 2:
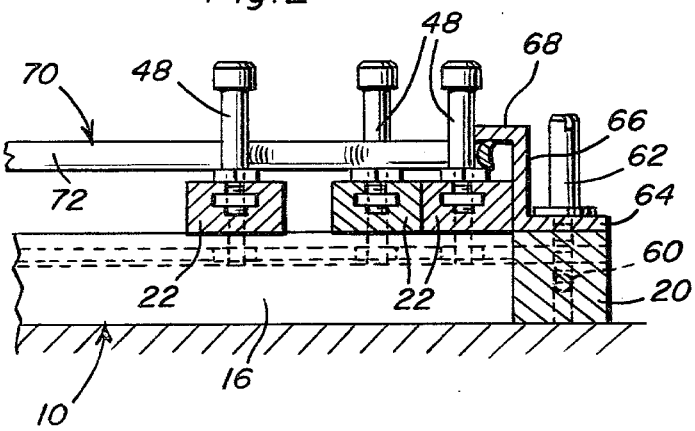
FIG. 2 is an enlarged fragmentary vertical sectional view taken substantially upon the plane indicated by the section line 2—2 of FIG. 1.
Figure 3:
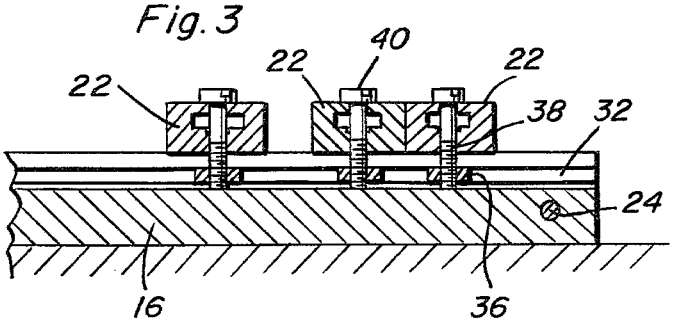
FIG. 3 is an enlarged fragmentary vertical sectional view taken substantially upon a plane indicated by the section line 3—3 of FIG. 1.
Figure 6:
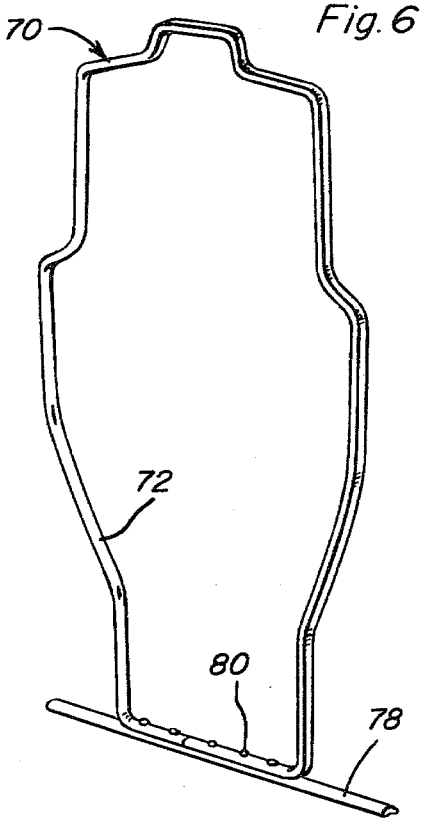
FIG. 6 is perspective view of an irregular shaped article of manufacture which may be produced through the utilization of the rod bending apparatus.
Figure 4:
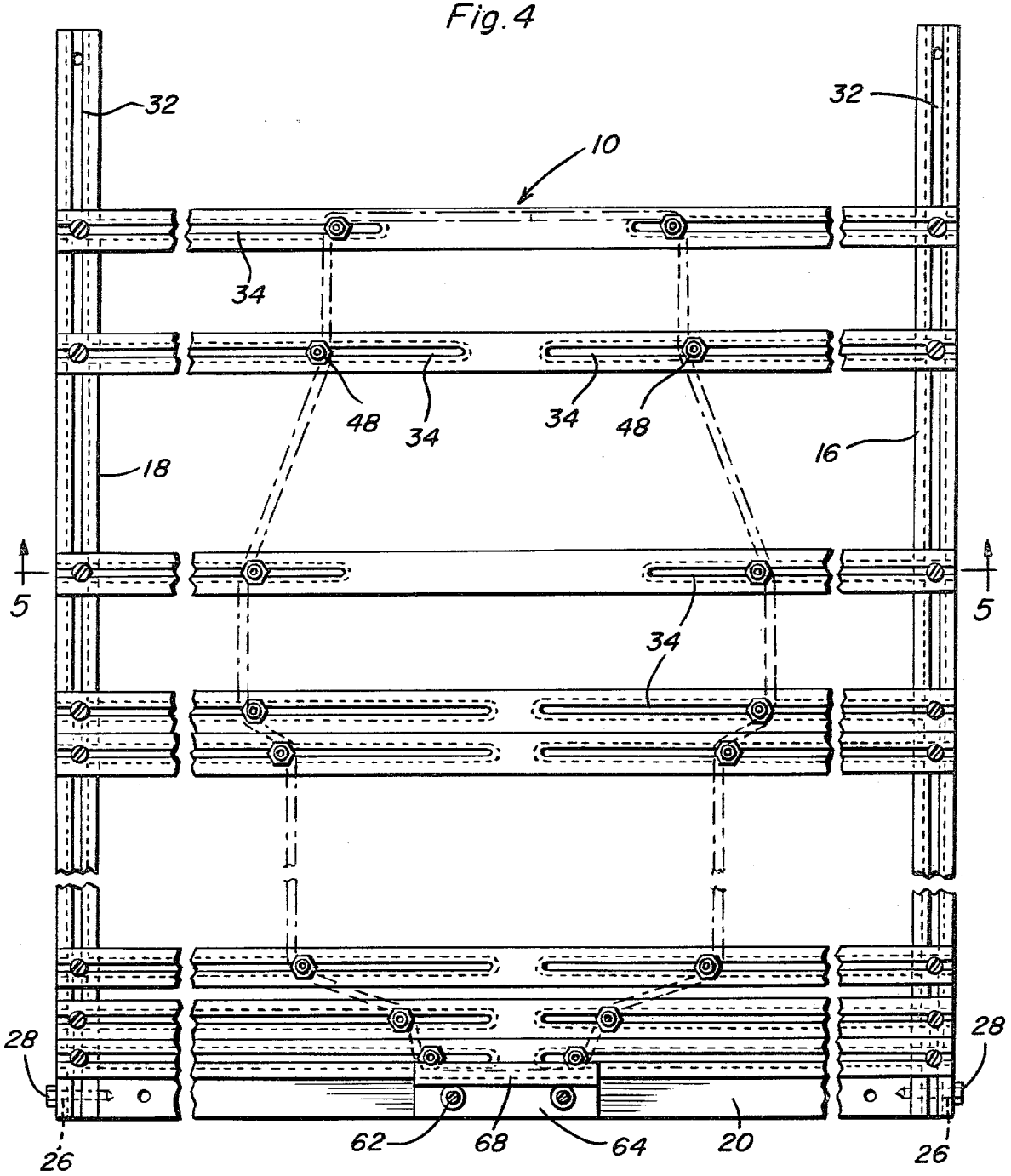
FIG. 4 is a fragmentary enlarged top plan view of the rod bending apparatus.
Figure 5:
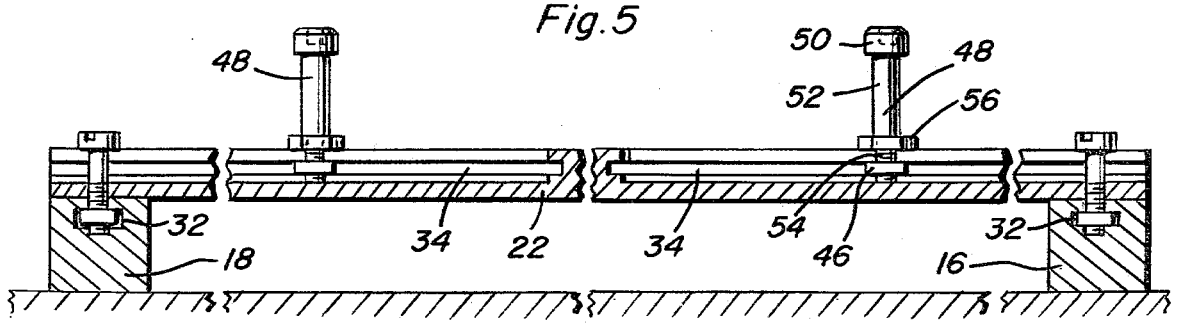
FIG. 5 is an enlarged fragmentary transverse sectional view taken substantially upon the plane indicated by the section line 5—5 of FIG. 4.

Referring now more specifically to the drawings, the numeral 10 generally designates the rod bending apparatus of the instant invention. The apparatus 10 is preferably utilized on a suitable horizontal support surface such as the top 12 of a worktable referred to in general by the reference numeral 14. The rod bending apparatus 10 includes a pair of generally parallel mounting members 16 and 18 rigidly joined together at one pair of corresponding ends by means of a connecting member 20 extending and secured therebetween. A plurality of laterally spaced elongated transverse guide members 22 extend between and have their opposite ends supported from corresponding portions of the mounting members 16 and 18.

The opposite ends of the connecting member 20 have blind threaded bores 24 formed therein and the adjacent ends of the mounting members 18 have transverse bores 26 formed therethrough. Threaded fasteners 28 are passed through the transverse bores 26 and are threaded in the blind bores 24. In this manner, the connecting member 20 is rigidly secured between the corresponding ends of the mounting members 16 and 18.

If it is desired, the opposite ends of the connecting member 20 may be secured to the worktable top 12 by suitable fasteners 30 and it may be seen that each of the mounting members 16 has a T-shaped longitudinal guideway 32 formed therein. In addition, each of the guide members 22 has a similar longitudinal guideway 34 formed therein, each guideway 32 has a plurality of threaded nuts 36 slidably disposed therein and the opposite ends of the guide members 22 have central vertical bores 38 formed therethrough registered with the guideways 32. Threaded headed fasteners 40 have their threaded shank portions passed downwardly through the bores 38 and threadedly engaged in corresponding nuts 36. In this manner, the fasteners 40 may be loosened in order to enable the guide members 22 to be laterally shifted longitudinally of the mounting members 16 and after the guide members 22 have been positioned as desired, the fasteners 40 may be tightened in order that the guide members 22 may be securely anchored in adjusted positions.

The guideways 34 comprise opposite end guideways formed in the guide members 22 and it may be seen from FIG. 1 of the drawings that the opposite end guideways 34 in various guide members 22 may be of different lengths.

Each of the guideways 34 has a threaded nut 46 slidably disposed therein and a bending post or pin 48 is provided for each guideway 34. Each post 48 includes an enlarged upper end head 50 and a smooth cylindrical shank 52 depending downwardly from the head. The lower end of the shank 52 terminates downwardly in a diametrically reduced threaded terminal end 54 having a jam nut 56 threadedly engaged thereon and the lower extremity of the terminal end 54 passes downwardly into the corresponding guideway 34 and is threadedly engaged in the corresponding nut 46.

The upper surface of each jam nut 56 abuts the upper surface of the corresponding guide member 22 and the nuts 46 and 56 may be tightened relative to each other on the diametrically reduced threaded terminal end 54 in order to tightly secure the posts 48 in adjusted shifted positions along the corresponding guide members 22. Of course, the nuts 56 and 46 may be loosened relative to each other to enable the posts 48 to be adjustably positioned along the guide members 22.

The central portion of the connecting member 20 has a pair of longitudinally spaced threaded bores 60 formed therein and shouldered clamp screws 62 are threadedly engaged in the bores 60 received through the lower flange portion 64 of a clamp plate 66 including an upper horizontal flange portion 68 which may overlie the guide member 22 adjacent the connecting member 20.

Assuming that an article of manufacture such as the sweater frame referred to in general by the reference numeral 70 is to be manufactured utilizing the apparatus 10 of the instant invention, a suitable length section 72 of rod material is selected after the posts or pins 48 have been adjusted as desired along the guide members 22 and the latter have been adjustably positioned along the mounting members 16 and 18. The central portion of the section 70 is engaged with the pins or posts 48 supported from the central portion of the guide member 22 adjacent the connecting member 20 and the clamp screws 62 are thereafter tightened in order that the upper horizontal flange portion 68 of the clamp plate 66 may clampingly secure the section 70 in position. Thereafter, a length of tubular pipe 74 is loosely telescoped over one of the end portions of the section 72 and utilized as a handle to successively bend that rod section end around the posts 48 on the corresponding side of the apparatus 10 in the manner illustrated in FIG. 1 of the drawings. Then, the pipe 74 is loosely telescoped over the other end of the section 72 and utilized to bend that rod section end around the corresponding posts 48 on the other side of the apparatus 10. After the free end portions of the rod section 72 have been finally bent toward each other in end abutting relation, a second rod section 78 may be anchored relative to the terminal ends of the section 72 as at 80 in order to complete the sweater frame 70 comprising the article of manufacture.

If it is desired, more than one post 48 may be operatively associated with each guideway 34 in order to enable other forms of articles of manufacture to be produced. Further, additional guide members 22 may be utilized, if desired, and the connecting member 20 may be modified to be utilized in conjunction with additional clamp plates similar to the clamp plate 66.

The fasteners 40 are of sufficient length to seat against the bottom of the associated guideway 32 and the lower terminal ends 54 of the posts 48 are of sufficient length to seat against the bottom of the corresponding guideways 34. Still further, the diametrically enlarged heads 50 of the posts 48 function to prevent the end portions of the sections 72 which are being bent about the posts from slipping upwardly from the upper ends thereof and it is to be noted that the cylindrical portions of the posts 52 may be provided with rotatable sleeves thereon of specific contour in the event specific contour rods or tubes are to be utilized in the manufacture of articles to be produced by use of the apparatus 10. Also, the upper ends of the jam nuts 56 abut the downwardly facing shoulders defined on the posts 48 at the upper ends of the threaded lower terminal ends 54.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An apparatus operable to perform selected rod bending operations, said apparatus including a pair of generally parallel support members, a plurality of laterally spaced elongated transverse guide members extending between said support members, the opposite ends of said guide members and said support members including first coacting clamp and guide structure supporting said guide member ends from said support members for adjustable shifting therealong and operative to releasably anchor said guide member ends in adjusted shifted positions along said support members, at least one post for each guide member, said posts and guide members including second coacting clamp and guide structure supporting said posts from said guide members for adjustable shifting therealong and operative to releasably anchor said posts in adjusted shifted positions along said support members, said posts being disposed substantially normal to a plane paralleling said support members and guide members.

2. The combination of claim 1 wherein said posts include extended end portions thereof which are substantially cylindrical and support diametrically enlarged heads on their terminal ends.

3. The combination of claim 1 wherein said first coacting clamp and guide structure includes longitudinal T-shaped slots formed in said support members and threaded fasteners journaled from the ends of said guide members, projecting into said slot and threadedly engaged with threaded nuts slidably received in said slots.

4. The combination of claim 1 wherein said second coacting clamp and guide structure includes longitudinally extending T-shaped slots formed in said guide members, said posts including lower ends projecting into said slots and threadedly engaged with threaded nuts slidably received in said slots.

5. The combination of claim 4 wherein the lower ends of said posts include diametrically reduced threaded terminal ends defining downwardly facing abutment shoulders, a lock nut threaded on each of said terminal ends and upwardly abutted against the corresponding shoulders, said terminal ends being threadedly engaged in the nuts slidably received in said guide members.

6. The combination of claim 1 wherein one pair of corresponding ends of said support members are anchored relative to the opposite ends of an elongated connecting member extending therebetween.

7. The combination of claim 6 including clamp structure carried by said connecting member and overlying the guide member adjacent said connecting member and movable toward and away from the last mentioned guide member to clamp a workpiece between said last mentioned guide member and said clamp structure.

8. The combination of claim 7 wherein said posts include extended end portions thereof which are substantially cylindrical and support diametrically enlarged heads on their terminal ends.

9. The combination of claim 8 wherein said second coacting clamp and guide structure includes longitudinally extending T-shaped slots formed in said guide members, said posts including lower ends projecting into said slots and threadedly engaged with threaded nuts slidably received in said slots.

10. The combination of claim 9 wherein the lower ends of said posts include diametrically reduced threaded terminal ends defining downwardly facing abutment shoulders, a lock nut threaded on each of said terminal ends and upwardly abutted against the corresponding shoulders, said terminal ends being threadedly engaged in the nuts slidably received in said guide members.

* * * * *